US008720002B2

(12) United States Patent
Gammack et al.

(10) Patent No.: US 8,720,002 B2
(45) Date of Patent: May 13, 2014

(54) HANDLE ASSEMBLY FOR A CLEANING APPLIANCE

(75) Inventors: Peter David Gammack, Malmesbury (GB); Andrew McCulloch, Malmesbury (GB); Benjamin John Strutt, Malmesbury (GB); Sarah Helen Liddell, Malmesbury (GB); William Robert James White, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 0 days.

(21) Appl. No.: 13/542,133

(22) Filed: Jul. 5, 2012

(65) Prior Publication Data

US 2012/0279012 A1 Nov. 8, 2012

Related U.S. Application Data

(63) Continuation of application No. 11/632,851, filed as application No. PCT/GB2005/002624 on Jul. 4, 2005, now Pat. No. 8,240,003.

(30) Foreign Application Priority Data

Jul. 22, 2004 (GB) ..... 0416355.6

(51) Int. Cl.
*A47L 9/00* (2006.01)
*A47L 5/00* (2006.01)

(52) U.S. Cl.
USPC ..... 15/410; 15/331; 15/335

(58) Field of Classification Search
USPC ..... 15/410, 331, 335
See application file for complete search history.

(56) References Cited

U.S. PATENT DOCUMENTS

| | | | | |
|---|---|---|---|---|
| 2,660,457 A | | 11/1953 | Mallon | |
| 2,867,833 A | * | 1/1959 | Duff | 15/323 |
| 4,377,882 A | * | 3/1983 | Dyson | 15/335 |
| 4,519,113 A | | 5/1985 | Hipple | |
| 4,573,236 A | * | 3/1986 | Dyson | 15/333 |
| 4,955,106 A | | 9/1990 | Stein et al. | |

(Continued)

FOREIGN PATENT DOCUMENTS

| | | |
|---|---|---|
| CA | 2 374 892 | 9/2002 |
| CN | 1136270 | 11/1996 |

(Continued)

OTHER PUBLICATIONS

Gammack, P. et al., U.S. Office Action mailed Jun. 24, 2010, directed to U.S. Appl. No. 11/632,851; 12 pages.

(Continued)

*Primary Examiner* — Bryan R Muller
(74) *Attorney, Agent, or Firm* — Morrison & Foerster LLP

(57) ABSTRACT

A handle assembly for a cleaning appliance such as a vacuum cleaner includes a flexible hose having a first end that is connectable to a main body of the cleaning appliance and a second end, a handle portion for maneuvering the handle assembly during use and a tubular wand. The second end of the flexible hose is connected to the handle portion, and the tubular wand is slidably mounted in the handle portion so as to be movable between a first position in which the tubular wand extends beyond the handle portion inside the flexible hose and a second position in which the tubular wand extends beyond the handle portion away from the flexible hose.

12 Claims, 5 Drawing Sheets

(56) References Cited

U.S. PATENT DOCUMENTS

| | | | | |
|---|---|---|---|---|
| 4,989,295 | A | 2/1991 | Guhne et al. | |
| 5,054,157 | A | 10/1991 | Werner et al. | |
| 5,331,715 | A | 7/1994 | Johnson et al. | |
| 5,358,290 | A * | 10/1994 | Fleet et al. | 285/7 |
| 5,462,311 | A | 10/1995 | Cipolla | |
| 5,867,862 | A | 2/1999 | Ahlf et al. | |
| 6,032,328 | A | 3/2000 | Harmon et al. | |
| 6,108,861 | A * | 8/2000 | Vystrcil et al. | 15/323 |
| 6,158,089 | A | 12/2000 | Monahan et al. | |
| 7,877,837 | B2 | 2/2011 | Gammack et al. | |
| 7,891,050 | B2 | 2/2011 | Liddell | |
| 2003/0101535 | A1 | 6/2003 | Gammack et al. | |
| 2004/0111828 | A1 | 6/2004 | Evans | |
| 2007/0072460 | A1 | 3/2007 | Stahle et al. | |
| 2007/0248406 | A1 | 10/2007 | Stahle et al. | |
| 2008/0131195 | A1 | 6/2008 | Stahle et al. | |
| 2008/0244860 | A1 | 10/2008 | Gammack et al. | |
| 2009/0038111 | A1 | 2/2009 | White et al. | |
| 2009/0038112 | A1 | 2/2009 | Wood | |
| 2009/0158548 | A1 | 6/2009 | Helps et al. | |
| 2010/0000044 | A1 | 1/2010 | Sanderson et al. | |

FOREIGN PATENT DOCUMENTS

| | | | |
|---|---|---|---|
| CN | 2347538 | | 11/1999 |
| CN | 1284843 | | 2/2001 |
| CN | 2669782 | | 1/2005 |
| CN | 200946612 | | 9/2007 |
| CN | 101053500 | | 10/2007 |
| CN | 201324205 | | 10/2009 |
| DE | 20 2007 005 035 | | 9/2007 |
| EP | 0 037 674 | | 10/1981 |
| EP | 0 134 654 | | 3/1985 |
| EP | 0 537 457 | | 4/1993 |
| EP | 0 937 435 | | 8/1999 |
| EP | 1 265 519 | | 12/2002 |
| EP | 1 380 247 | | 1/2004 |
| EP | 1380247 | A2 * | 1/2004 |
| GB | 2 329 944 | | 4/1999 |
| GB | 2 359 735 | | 9/2001 |
| GB | 2 392 827 | | 3/2004 |
| GB | 2 396 896 | | 7/2004 |
| GB | 2 413 943 | | 11/2005 |
| GB | 2 416 296 | | 1/2006 |
| GB | 2 439 915 | | 1/2008 |
| GB | 2 440 718 | | 2/2008 |
| JP | 45-545 | | 1/1970 |
| JP | 56-91558 | | 7/1981 |
| JP | 3-261434 | | 11/1991 |
| JP | 4-303406 | | 10/1992 |
| JP | 5-68461 | | 9/1993 |
| JP | 2005-143724 | | 6/2005 |
| JP | 2007-185222 | | 7/2007 |
| WO | WO-97/33510 | | 9/1997 |
| WO | WO-01/65989 | | 9/2001 |
| WO | WO 0165989 | A2 * | 9/2001 |
| WO | WO-03/101273 | | 12/2003 |
| WO | WO-2005/079648 | | 9/2005 |
| WO | WO-2005/110178 | | 11/2005 |
| WO | WO-2006/008443 | | 1/2006 |
| WO | WO-2006/008444 | | 1/2006 |

OTHER PUBLICATIONS

Gammack, P. et al., U.S. Office Action mailed Dec. 10, 2010, directed to U.S. Appl. No. 11/632,851; 15 pages.

Gammack, P. et al., U.S. Office Action mailed Oct. 14, 2011, directed to U.S. Appl. No. 11/632,851; 14 pages.

Wood, R. M., U.S. Office Action mailed Mar. 30, 2011, directed to U.S. Appl. No. 12/185,635; 7 pages.

White, R., et al., U.S. Office Action mailed Feb. 10, 2011, directed to U.S. Appl. No. 12/184,858; 6 pages.

Helps, D. F., U.S. Office Action mailed May 27, 2011, directed to U.S. Appl. No. 12/338,785; 7 pages.

Helps, D. F., U.S. Office Action mailed Feb. 7, 2012, directed to U.S. Appl. No. 12/338,785; 6 pages.

* cited by examiner

HANDLE ASSEMBLY FOR A CLEANING APPLIANCE

REFERENCE TO RELATED APPLICATIONS

This application is a continuation of U.S. patent application Ser. No. 11/632,851, filed May 8, 2008, which is a national stage application under 35 USC 371 of International Application No. PCT/GB2005/002624, filed Jul. 4, 2005, which claims the priority of United Kingdom Application No. 0416355.6, filed Jul. 22, 2004, the contents of which prior applications are incorporated herein by reference.

FIELD OF THE INVENTION

The invention relates to a handle assembly for a cleaning appliance, particularly but not exclusively to a handle assembly for a vacuum cleaner of the upright type.

BACKGROUND OF THE INVENTION

The general construction and method of operation of upright vacuum cleaners are both well known. Also well known is the capability of upright vacuum cleaners to be converted from a traditional upright cleaning mode (in which the entire vacuum cleaner is maneuvered across a floor surface) into a cylinder mode for "above-the-floor" cleaning. For such purposes, upright cleaners often incorporate an integral hose and wand arrangement which can be brought into operation when required. In some cases, the hose and wand assembly consists of an integral hose which forms part of the airflow path between the cleaner head and the separation apparatus when the machine is used in upright mode, with one end of the hose being releasable from a socket in the main body when above-the-floor cleaning is to be carried out. A separate wand, which is often carried on the main body of the vacuum cleaner, can then be attached to the hose for improving the reach of the hose and wand assembly. A disadvantage of this type of arrangement is that, when the machine is used in upright mode, the incoming air still has to travel through the hose which unnecessarily increases losses.

Another known type of hose and wand assembly is that used on the Dyson range of upright vacuum cleaners, model numbers DC01, DC03, DC04 and DC07. In these vacuum cleaners, the lower end of the hose is fixedly connected to the main body of the respective cleaner but the upper end is slidingly connected to the tubular portion of a wand handle. The wand handle comprises a moulded handle portion with a tubular wand rigidly connected thereto. The handle portion can be attached to the main body of the vacuum cleaner and used in the manner of a handle, in which case the upper end of the hose is slid to the upper end of the wand so that the wand is then stored inside the hose. When above-the-floor cleaning is required, the handle portion is released from the main body, the upper end of the hose is slid to the lower end of the wand and tools can be attached to the handle portion to effect the cleaning required. A valve arrangement automatically selects the point of entry of the dirty air into the vacuum cleaner: in upright mode the point of entry is via the cleaner head and for "above-the-floor" cleaning the point of entry is via the hose and wand. The principle by which this entire arrangement operates is described in EP 0037674B.

A disadvantage of this arrangement is that, because the handle portion is designed to be used as the handle of the machine in the upright mode, the arrangement of the handle is not ideally suited for "above-the-floor" mode. The user tends to grip the lower end of the wand remote from the handle portion when carrying out "above-the-floor" cleaning, at least when cleaning areas at high levels such as cornices and curtain rails. In a refinement of the arrangement, some Dyson vacuum cleaners have incorporated a hose and wand assembly in which the handle portion and wand can be released from the upper end of the hose, turned around and reconnected in the reverse orientation. In this way, when the hose and wand assembly is to be used for "above-the-floor" cleaning, the hose is attached to the handle portion with the wand then projecting away from the hose. This provides better grip for the user and better balance of the handle and wand during use. This arrangement is shown and described in detail in WO 01/65989. A disadvantage of even this refined arrangement is that the user is required to disassemble and reassemble the hose and wand assembly prior to use for "above-the-floor" cleaning and then, of course, to reverse the operation before returning to normal upright mode. This can result in incorrect assembly which could lead to a reduction in performance due to air being bled into the assembly through inefficient seals.

SUMMARY OF THE INVENTION

The present invention seeks to provide an improved handle assembly for a vacuum cleaner which obviates the disadvantages of the prior art.

The invention provides a handle assembly for a cleaning appliance comprising a flexible hose having a first end connectable to a main body of the cleaning appliance and a second end, a handle portion for manoueuvring the cleaning appliance across a surface to be cleaned, and a tubular wand, characterised in that the second end of the flexible hose is connected to the handle portion and the tubular wand is slidably mounted in the handle portion so as to be slidable between a first position in which the tubular wand extends beyond the handle portion away from the flexible hose and a second position in which the tubular wand extends beyond the handle portion inside the flexible hose.

The handle assembly according the invention has the advantages of the prior art in that it is integral with the vacuum cleaner and does not requires separately stored parts to be assembled together before use, and in that the handle portion can easily be gripped and manoeuvred during "above-the-floor" cleaning. In addition, however, the time-consuming and awkward task of removing the wand handle and reversing its orientation no longer needs to be carried out in order to achieve this. The handle assembly according to the invention is thus easier to operate and more reliable than the known assemblies.

In a preferred arrangement, the handle portion carries a moveable cap which is arranged to cover an end of the tubular wand when the tubular wand is in the second position. Preferably, the moveable cap is mounted on the handle portion in a snap-fit manner. More preferably, the moveable cap is moved into an open position by the tubular wand when the tubular wand is moved from the second position to the first position. This arrangement is a simple but effective way of providing a cover for the end of the wand when the handle portion is being used as a handle in the upright mode.

In a further preferred embodiment, the tubular wand is held in the first position by a releasable catch mechanism located in the handle portion. Preferably, the releasable catch mechanism comprises a catch which interengages with a detent in the tubular wand, and inclined facing surfaces located on the handle portion and the catch, the arrangement being such that an axial force applied to the tubular wand will urge the catch into the detent. This mechanism ensures that, when the handle assembly is being used for "above-the-floor" cleaning, any forces applied to the tubular wand which would encourage it to move from the first position to the second position in fact urge the catch further into engagement with the detent. This is essentially, therefore, a self-locking mechanism and will reduce the risk of the tubular wand becoming inadvertently released from the first position.

Other preferable and advantageous features of the invention are set out in the detailed description below.

BRIEF DESCRIPTION OF THE DRAWINGS

An embodiment of the invention will now be described with reference to the accompanying drawings in which.

DETAILED DESCRIPTION OF THE INVENTION

Figure 1:
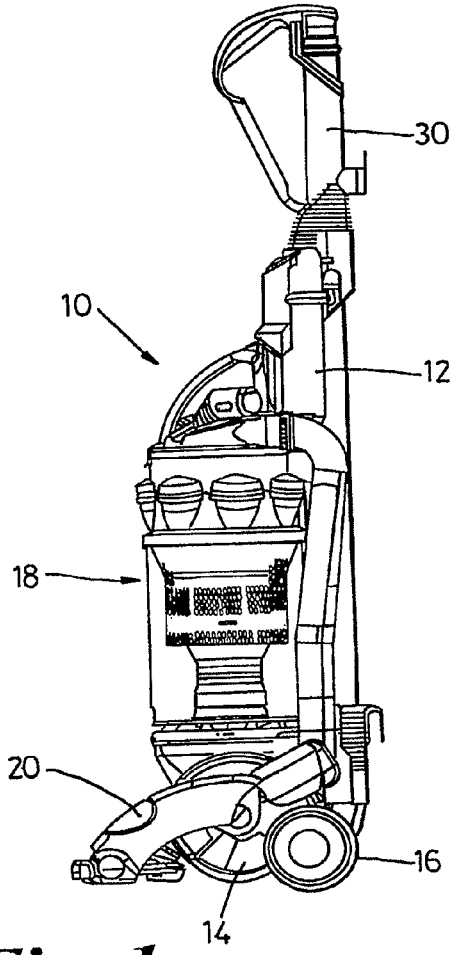
FIG. 1 is a side view of a vacuum cleaner incorporating a handle assembly according to the invention.

A vacuum cleaner incorporating a handle assembly according to the invention is shown in FIG. 1. The upright vacuum cleaner 10 shown in FIG. 1 has a main body 12 which includes a motor casing 14, supporting wheels 16 and dirt- and dust-separating apparatus 18. The vacuum cleaner 10 also has a cleaner head 20 and a handle assembly 30. In the embodiment shown, the dirt- and dust-separating apparatus 18 comprises a cyclonic arrangement but this could readily be replaced by a filter, a bag or a combination of different known separation devices. The nature of the dirt- and dust-separating apparatus 18 is not material to the present invention.

It will be understood that, in normal upright use, the vacuum cleaner 10 is maneuvered over a surface to be cleaned (a floor surface) whilst the motor causes dirty air to be sucked into the cleaner 10 via the cleaner head 20. The dirty air is passed to the dirt- and dust-separating apparatus 18 where the dirt and dust is extracted and clean air is expelled to the atmosphere.

Figure 2:
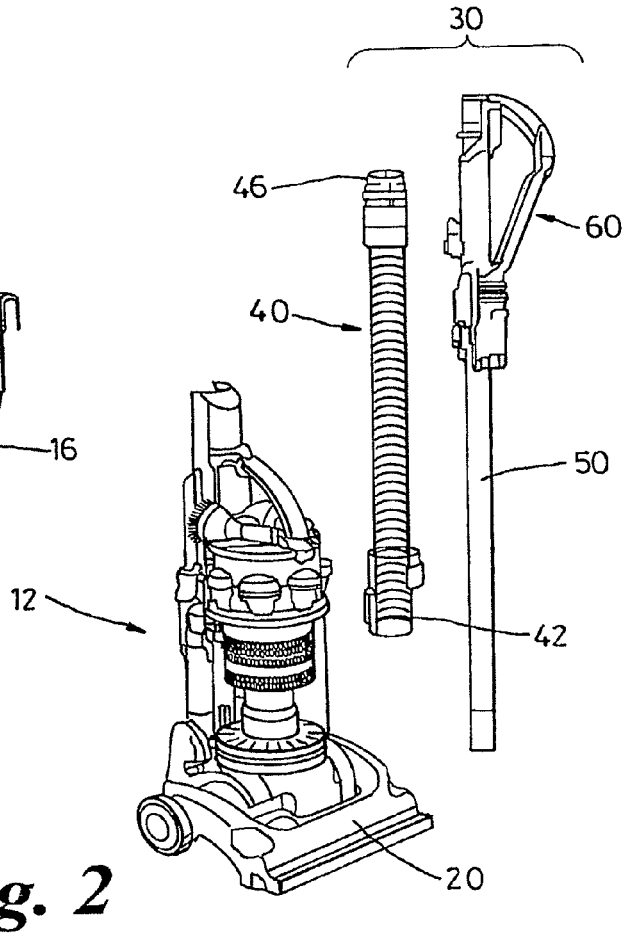
FIG. 2 is a perspective view of the vacuum cleaner of FIG. 1 showing the hose and the wand handle removed from the main body.

FIG. 2 shows the vacuum cleaner 10 with the handle assembly 30 separated from the main body 12. The handle assembly 30 comprises a hose 40 having a first end 42 and a second end 46, a tubular wand 50 and a handle portion 60. The first end 42 of the hose 40 is normally connected to the main body 12 behind the motor casing 14. The upper end 46 of the hose 40 is connected to the handle portion 60. Both of these connections are preferably releasable connections to facilitate maintenance and repair. The tubular wand 50 is slidably mounted in the handle portion 60 as will be described in more detail below.

Figure 3:
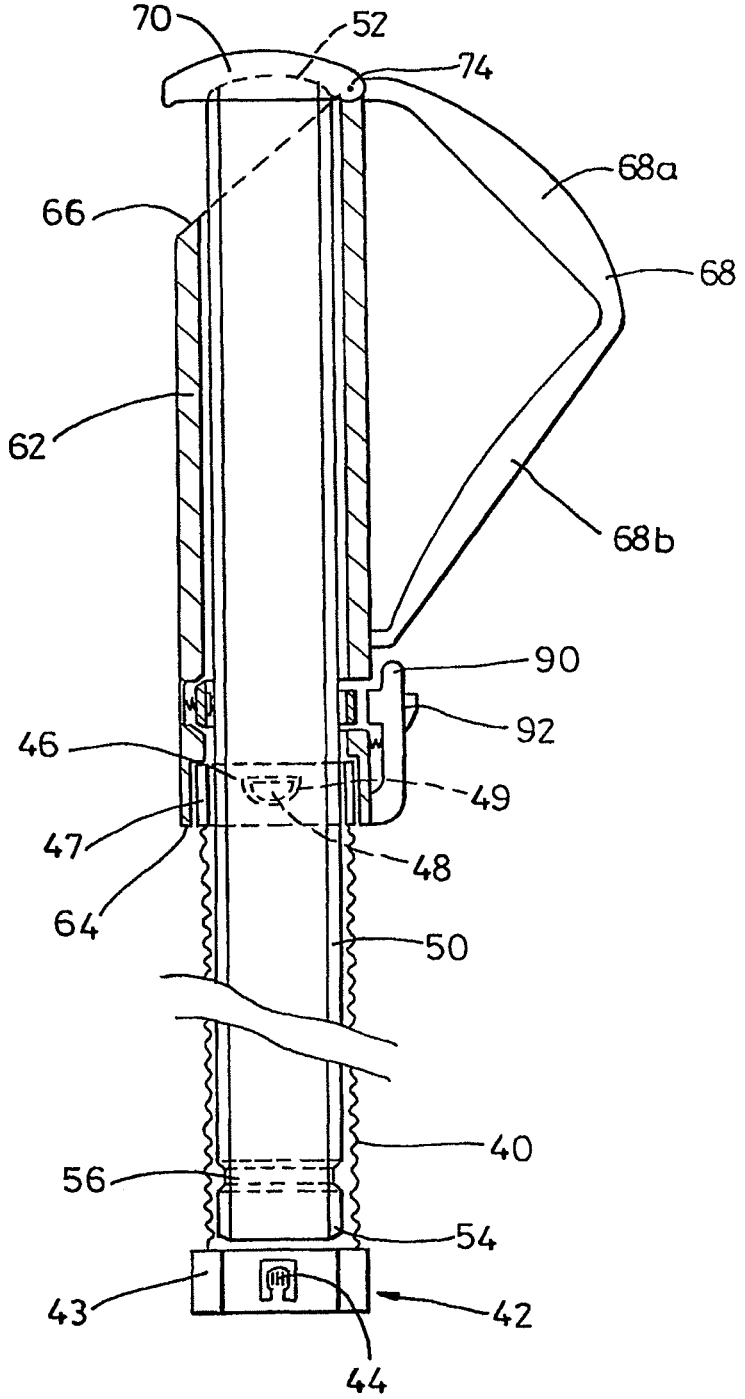
FIG. 3 is a schematic sectional view through the handle assembly forming part of the vacuum cleaner shown in FIGS. 1 and 2 and showing the handle assembly in the first position.

FIG. 3 shows the handle assembly 30 in detail, although not to scale. The hose 40 is a sprung hose and is ideally (but not essentially) of sufficient length to enable a full flight of stairs to be cleaned with the vacuum cleaner main body 12 remaining at the foot of the stairs. The first end 42 of the hose 40 has a collar 43 overmoulded or otherwise securely fixed thereto with at least one resilient catch 44 incorporated therein. The resilient catch 44 co-operates with a recess (not shown) in a socket on the main body 12 in which the first end 42 of the hose 40 is received. The catch 44 and recess together form a releasable connection between the first end 42 of the hose 40 and the main body 12. This type of connection is well known and similar types of releasable connection would be equally suitable for use in this application.

The second end 46 of the hose 40 has a similar releasable connection formed by a resilient catch 48 moulded into a collar 47 which is overmoulded or otherwise securely fastened to the second end 46 of the hose 40. However, in the case of the second end 46 of the hose 40, the resilient catch 48 is arranged to be received in a recess or aperture 49 moulded into the lower end of the handle portion 60. Again, the type of connection formed by the catch 48 and the recess 49 is well known and could be replaced by another type of connector having similar functionality.

The handle portion 60 will now be described in detail. The handle portion 60 essentially comprises a tubular part 62 having open ends 64, 66. The lower end 64 of the tubular part 62 includes the recess or recesses 49 which receive the resilient catch or catches 48 at the second end 46 of the hose 40. The internal diameter of the tubular part 62 is dimensioned so that the tubular wand 50 is able to slide within the tubular part 62. A gripping handle 68 is integrally moulded or is otherwise fixedly attached to a side wall of the tubular part 62 and extends laterally therefrom. Ideally, the gripping handle 68 has a first gripping area 68*a* which is designed for use when the vacuum cleaner 10 is being used for upright cleaning and a second gripping area 68*b* which is designed for use when the vacuum cleaner 10 is being used for "above-the-floor" cleaning.

A cap 70 is pivotably mounted on the tubular part 62 at the upper end 66 thereof. The cap 70 is moveable between a generally horizontal closed position and a generally vertical open position. The cap 70 has a generally circular shape when viewed from above and has a number of bleed holes through which air is able to pass if required. In the position shown in FIG. 3, the cap 70 covers the upper end of the tubular wand 50, although the bleed holes allow air to be drawn into the tubular wand 50 whilst simultaneously preventing large objects from being drawn into the vacuum cleaner 10.

Figure 6:
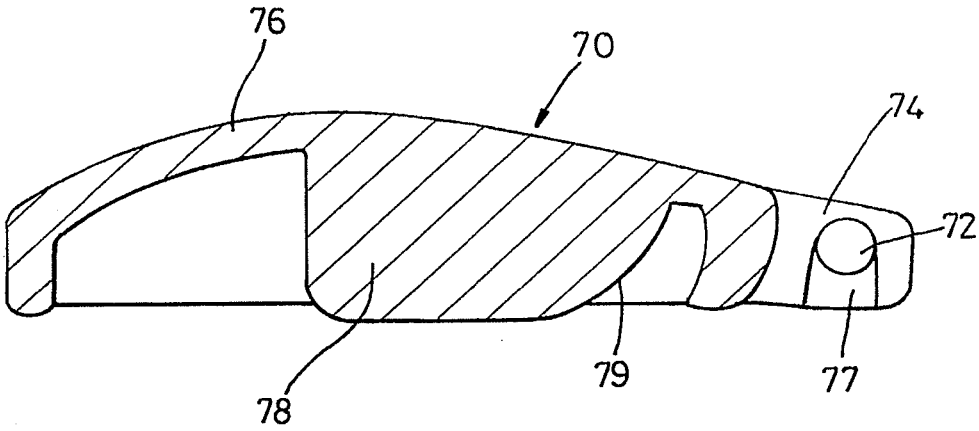
FIG. 6 is a sectional view through the cap forming part of the handle assembly of FIGS. 3 and 4.

The cap 70 is mounted on the upper end of the tubular part 62 by the engagement of two opposed pivot pins (formed on the upper end 66 of the tubular part 62) in corresponding recesses 72 formed in the cap 70 (see FIG. 6). The recesses 72 are formed in lugs 74 which project rearwardly from the main part 76 of the cap 70. The lugs 74 are formed from a resilient plastics material and lead-in channels 77 are provided between the apertures 72 and the lower edge of each lug 74. This arrangement allows the cap 70 to be attached to the tubular part 62 in a snap-fit manner. Shapings (in the form of a protrusion formed on each lug 74 next to each aperture 72 and co-operating profiled channels formed in the tubular part 62 next to the pivot pins) allow the cap 70 to be urged into one of two definite positions: either the cap 70 is urged into the horizontal position shown in FIG. 3 or it is urged into the substantially vertical position shown in FIG. 4.

The underside of the main part 76 of the cap 70 carries a depending portion in the shape of a rib or fin 78. This rib or fin 78 has a contact surface 79 on the side of the rib or fin 78 facing the lugs 74. The purpose of the rib or fin 78 will be described below.

The tubular wand 50 is arranged inside the tubular part 62 of the handle portion 60. The tubular wand 50 has rounded upper and lower ends 52, 54. The diameter of the tubular wand 50 is such that it will fit with clearance inside the interior of the tubular part 62 and also inside the hose 40. The tubular wand 50 has a groove 56 formed in its outer surface near the lower end 54 thereof. This groove 56 co-operates with a catch mechanism forming part of the handle portion 60 as will be described in more detail below. The upper end 52 of the tubular wand 50 is dimensioned so that it is able to receive floor tools and accessory tools (not shown) which are intended to be used with the vacuum cleaner 10 during "above-the-floor" cleaning. The length of the tubular wand 50 is such that, when the cap 70 is in its horizontal position and the hose is in its relaxed (shortest) state, the tubular wand 50 extends between the cap 70 and the collar 43 at the first end of the hose 40.

A groove (not shown) extends longitudinally along the entire length of the tubular wand 50 on the side thereof facing the gripping handle 68. A small protrusion (also not shown) located on the interior of the tubular part 62 projects into the groove to prevent the tubular wand 50 from rotating about its longitudinal axis with respect to the handle portion 60.

Figure 5:
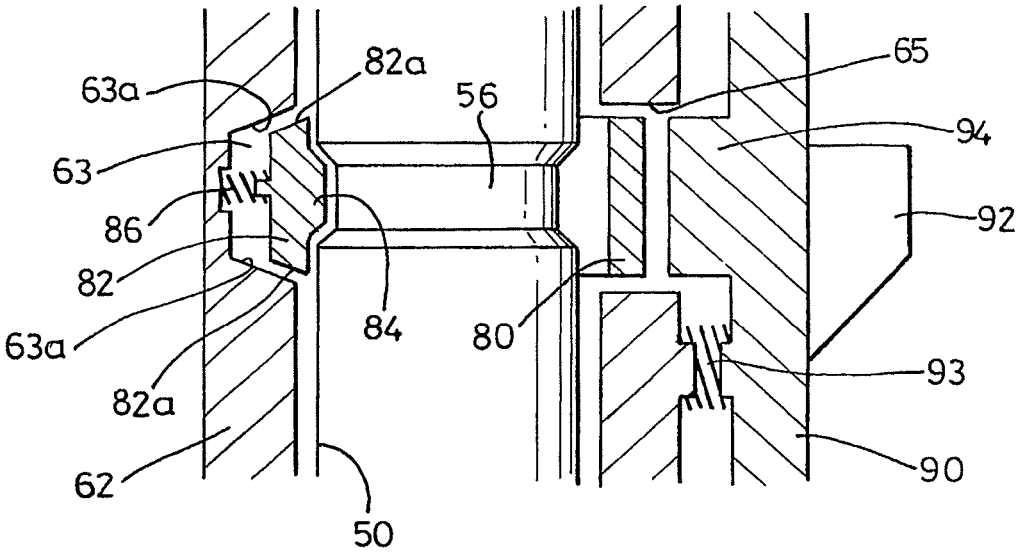
FIG. 5 is a schematic sectional view through a part of the wand handle of FIGS. 3 and 4.

The catch mechanism forming part of the handle portion 60 is shown more clearly in FIG. 5. Mounted in an annular recess 63 inside the tubular part 62 is an eccentric ring 80 which surrounds the tubular wand 50. The ring 80 has an enlarged shaped part 82 which carries an inwardly extending projection 84. The projection 84 is dimensioned so as to engage with the groove 56 formed in the tubular wand 50 when the projection 84 and the groove 56 are in alignment. A spring 86 urges the ring 80 to the right as shown in FIG. 5 so that, when the projection 84 and the groove 56 are aligned, the projection 84 is moved into the groove 56. The spring 86 is seated in a small recess in the recess 63 and a tab on the shaped part 82 of the ring 80.

A handle release catch 90 is pivotably mounted on the tubular part 62 of the handle portion 60 as shown in FIG. 3. The handle release catch 90 carries a catch 92 which co-operates with a recess on the main body 12 of the vacuum cleaner 10 so as to secure the handle assembly 60 onto the main body 12 for storage and for upright cleaning. A spring 93 urges the handle release catch away from the tubular part 62 and stop means (not shown) limit the movement of the handle release catch 90 in that direction. Such arrangements are well known. However, in the present embodiment of the invention, an actuator 94 is provided on the rear surface of the handle release catch 90. The actuator 94 takes the form of a projection which projects rearwardly from the rear surface of the handle release catch 90 towards the tubular part 62 of the handle assembly 30. An opening 65 is formed in the tubular part 62 of the handle portion 60 opposite the spring 86. This opening 65 allows the actuator 94 to pass through the tubular part 62 and to come into contact with the ring 82 when the handle release catch is pressed against the action of the spring 93. It will thus be appreciated that the catch mechanism described above is integral with the handle release catch 90. It will further be appreciated that the catch mechanism is operated by the same action as that required to operate the handle release catch 90 and thus release the handle assembly 30 from the main body 12 of the vacuum cleaner 10.

It is to be noted that the shape of the enlarged shaped part 82 and the recess 63 are such that the catch mechanism is self-locking. To that end, the recess 63 has inclined walls 63*a* adjacent the enlarged shaped part 82 and the facing walls 82*a* of the enlarged shaped part 82 are also inclined. The result is that, when the projection 84 is engaged in the groove 56, any axial forces applied to the tubular wand 50 (resulting in a small amount of relative movement between the tubular part 62 and the eccentric ring 80) will force the projection 84 further into the groove 56. This reduces the risk of the projection 84 slipping out of the groove 56 and causing a sudden and unexpected collapse of the handle assembly 30.

FIG. 3 illustrates the relative positions of all of the components of the handle assembly 30 when the handle assembly 30 is stored on the main body 12 of the vacuum cleaner 10 or is being used for upright cleaning. The collar 43 is connected to the socket (not shown) on the main body 12 and the catch 92 on the handle release catch 90 is engaged with the relevant recess on the main body 12 to secure the handle assembly 30 on the main body 12. In this position, the tubular wand 50 is in its first position extending away from the handle portion 60 inside the hose 40. The hose 40 is in its relaxed state and so is as short as possible in this configuration. The lower end 54 of the tubular wand 50 reaches substantially to the first end 42 of the hose 40. The tubular wand 50 is prevented from sliding out of the hose 40 by the fact that the collar 43 has an internal diameter which is slightly smaller than the outer diameter of the tubular wand 50.

The upper end 52 of the tubular wand 50 extends through the tubular part 62 of the handle portion 60 as far as the upper end 66. The cap 70 is in its horizontal position as shown so that the otherwise open upper end 52 of the tubular wand 50 is covered to prevent debris being sucked into the tubular wand 50.

Figure 4:
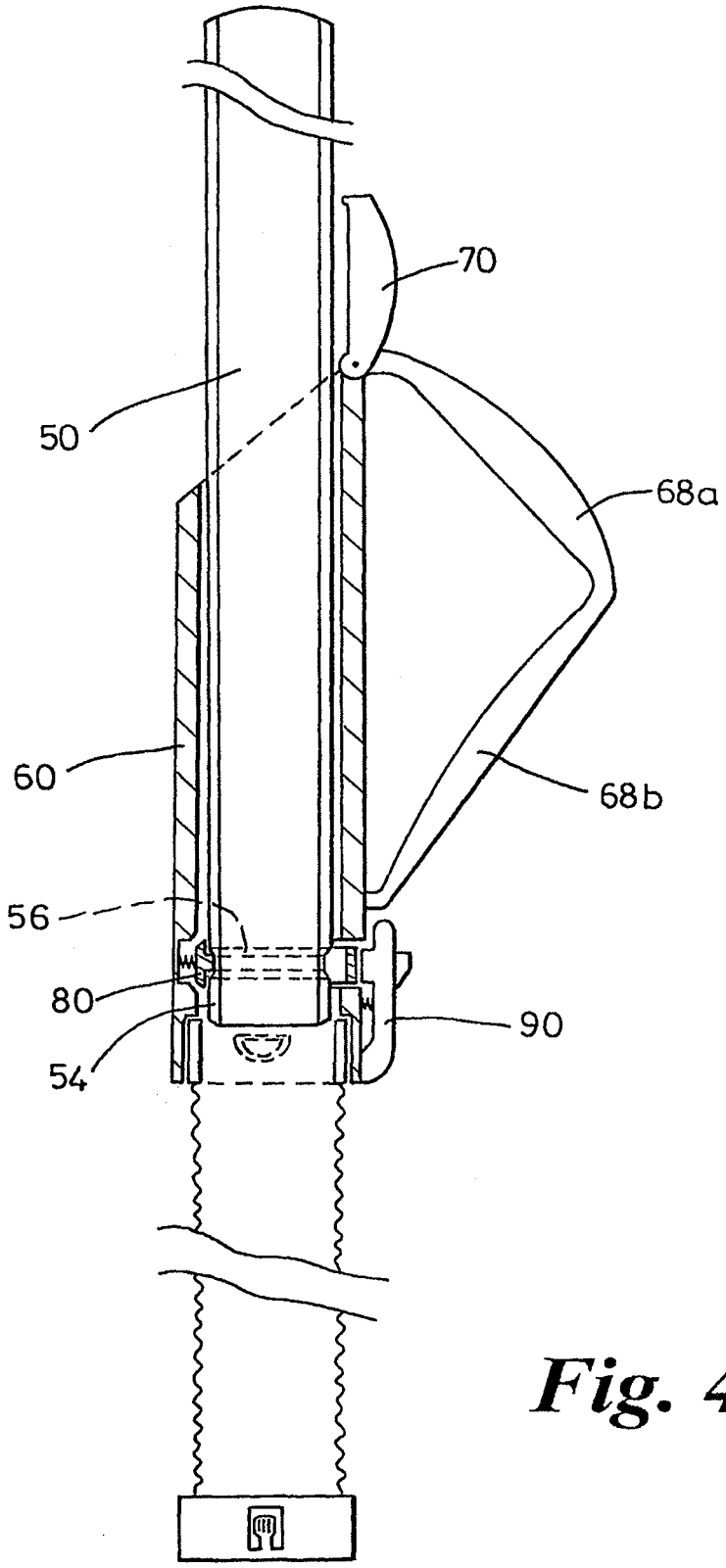
FIG. 4 is a view similar to FIG. 3 but with the handle assembly shown in the second position.

FIG. 4 illustrates the second configuration of the handle assembly 30 with the tubular wand 50 in its second position. In this position, the tubular wand 50 has been slidingly moved upwards relative to the handle portion 60 until the groove 56 becomes aligned with the eccentric ring 80. The eccentric ring 80 is pressed into the groove 56 under the action of the spring 86 to lock the tubular wand 50 relative to the handle portion 60. (The position of the components of the catch mechanism are as shown in FIG. 5.) Because the lower end 54 of the tubular wand 50 is now located within the handle portion 60, the hose 40 is free to flex and move in order to facilitate above-the-floor cleaning.

As the tubular wand 50 is moved from the position shown in FIG. 3 to the position shown in FIG. 4, the cap 70 is automatically pivoted from the generally horizontal position shown in FIG. 3 to the generally vertical position shown in FIG. 4. This is achieved simply by the movement of the tubular wand 50 with respect to the handle portion 60. As the upper end 52 of the tubular wand 50 is moved towards the cap 70, the upper end 52 comes into contact with the contact surface 79 of the rib or fin 78 on the underside of the cap 70. The inclined shape of the contact surface 79 causes the cap 70 to rotate clockwise as the tubular wand 50 is moved upwardly, thus automatically moving out of the path of the tubular wand 50. The shapings described above cause the cap 70 to be held in the generally vertical position whilst the tubular wand 50 remains in its second position.

In this configuration, the handle assembly 30 is highly suitable for above-the-floor cleaning. Furthermore, the self-locking characteristics of the catch mechanism mean that a reasonable amount of force can be applied to the wand 50 without the catch mechanism failing and causing the handle assembly 30 to collapse. In this configuration, it is expected (but not dictated) that the user will grip the handle assembly 30 using the second gripping area 68*b* rather than using the first gripping area 68*a*.

When it is desired to return the handle assembly 30 to the first configuration, the user is able simply to depress the handle release catch 90 towards the handle portion 60 against the action of the spring 93. The actuator 94 presses against the eccentric ring 80 and releases the projection 84 from the groove 56 in the tubular wand 50. The tubular wand 50 is thus able to slide within the handle portion 60 back to the first position as shown in FIG. 3. The hose 40 is again stored around the tubular wand 50 and the handle assembly 30 can be re-attached to the main body 12 of the vacuum cleaner 10. The cap 70 is pressed into its generally horizontal position by the user.

Figure 7C:
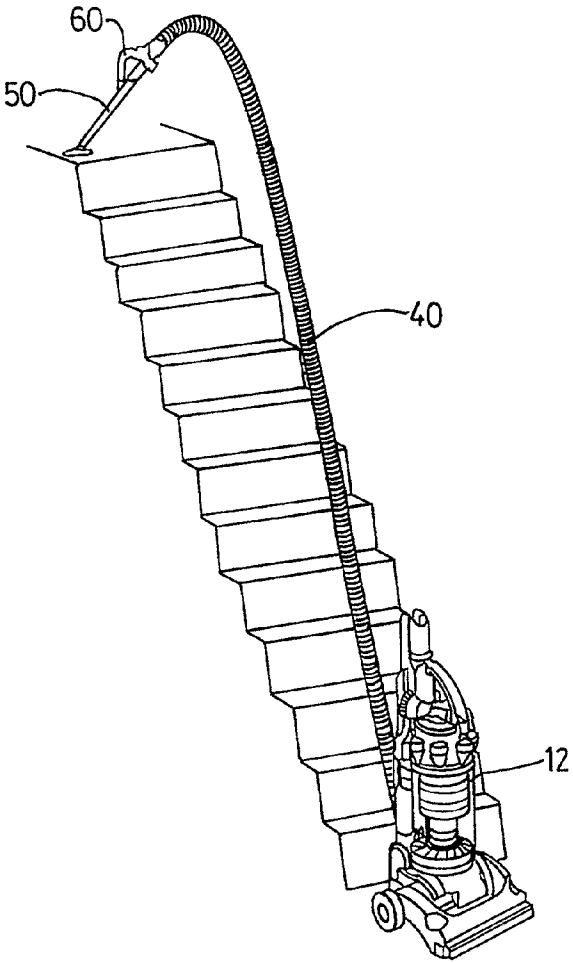
FIGS. 7(*a*), 7(*b*) and 7(*c*) are sequential views of the vacuum cleaner of FIG. 1 illustrating the use of the handle assembly according to the invention.
Figure 7B:
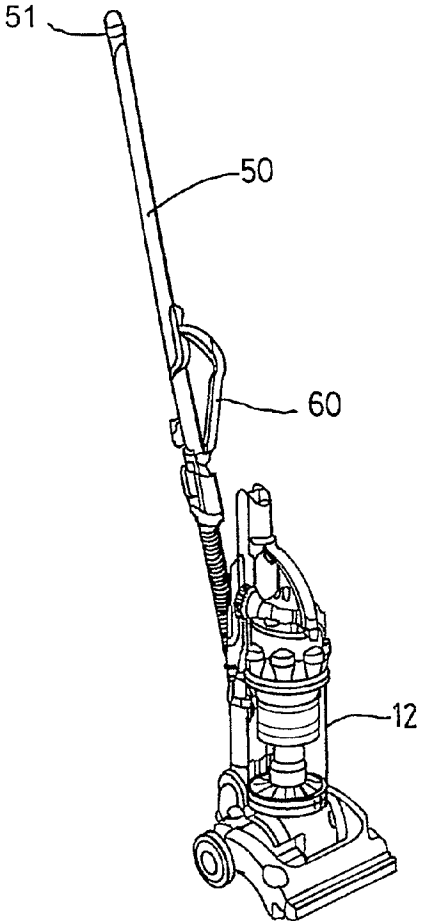
Figure 7A:
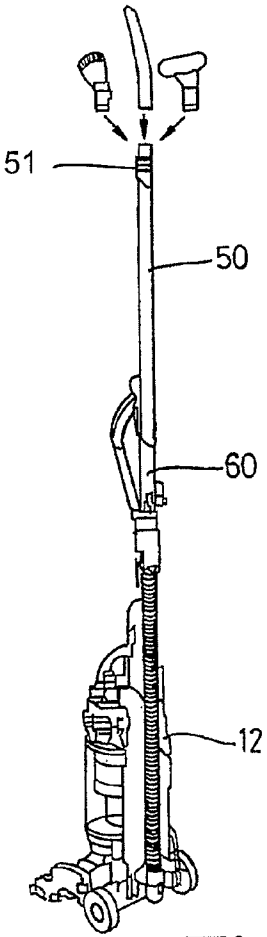

FIGS. 7(*a*), 7(*b*) and 7(*c*) illustrate the intended steps to be taken when converting the vacuum cleaner 10 from upright cleaning to above-the-floor cleaning. First, as shown in FIG. 7(*a*), the tubular wand 70 is extended upwardly with the handle assembly 30 otherwise still attached to the main body 12. Tools are attached to the upper end of the tubular wand 50. The handle release catch 90 is then operated so as to release the handle portion 60 from the main body 12 and the hose 40 is then extended to reach up a flight of stairs or for other above-the-floor cleaning. To re-attach the handle assembly 30, the steps are simply reversed.

It will be appreciated that the invention is not intended to be limited to the specific details of the embodiment described. Different arrangements and modifications will be apparent to a skilled reader. For example, the configuration of the gripping areas could be very different in design, as could the catches and the cap. Another possible modification would be to provide a plastics moulded end portion on the upper end of the tubular wand. Such an end portion would facilitate the attachment of tools and accessories to the wand and would allow the dimensions of the upper end of the wand to be varied without altering the construction of the main part of the tubular wand. A convenient way of attaching such an end portion to the tubular wand is by way of a plastic circlip seated in a groove moulded into the end portion and having projections extending radially inwards to engage with apertures or detents formed in the aluminium wand. Providing an end portion on the upper end of the tubular wand has an added advantage in that, provided that the end portion is larger than the internal diameter of the tubular part of the handle portion, the end portion will act as a stop 51 which prevents the upper end of the tubular wand from becoming inaccessible by sliding to a position inside the handle portion or the hose.

The invention claimed is:

1. A cleaning appliance, comprising:

a main body;

a handle portion releasably attached to the main body of the cleaning appliance for maneuvering the appliance across a surface to be cleaned;

a flexible hose having a first end and a second end, the first end of the flexible hose being connected to the main body of the cleaning appliance, the second end of the flexible hose having a collar, the collar releasably connecting the second end of the hose to the handle portion; and a tubular wand, having a first end and a second end, wherein the tubular wand is slidably mounted in the handle portion so as to be slidable between a first position in which the tubular wand extends beyond the handle portion inside the flexible hose and in which the first end of the tubular wand is proximate the handle portion and the second end of the tubular wand is distal to the handle portion, and a second position in which the tubular wand extends beyond the handle portion away from the flexible hose and in which the second end of the tubular wand is proximate the handle portion and the first end of the tubular wand is distal to the handle portion.

2. The cleaning appliance of claim 1, wherein the handle portion carries a moveable cap which is configured to cover one end of the tubular wand when the tubular wand is in the first position.

3. The cleaning appliance of claim 2, wherein the moveable cap comprises a plurality of flexible portions and the handle portion comprises a plurality of receiving portions, and wherein the movable cap is mounted on the handle portion in a snap-fit manner such that each of the plurality of flexible portions is coupled to one of the plurality of receiving portions.

4. The cleaning appliance of claim 2, wherein the moveable cap comprises a depending portion on the side thereof facing the tubular wand, the depending portion having a contact surface which, in use, is contacted by the tubular wand when the tubular wand is moved from the first position to the second position.

5. The cleaning appliance of claim 1, wherein the tubular wand is held in the second position by a releasable catch mechanism located in the handle portion.

6. The cleaning appliance of claim 5, wherein the releasable catch mechanism comprises a catch which engages with a detent in the tubular wand, and inclined facing surfaces located on the handle portion and the catch, the arrangement being such that an axial force applied to the tubular wand when the catch is engaged with the detent will urge the catch into the detent.

7. The cleaning appliance of claim 1, wherein the handle portion is releasably attached to the main body by a catch mechanism which is integral with a releasable catch mechanism which is located in the handle portion and holds the tubular wand in the second position.

8. The cleaning appliance of claim 1, wherein the one end of the tubular wand carries a stop which prevents the upper end of the tubular wand from sliding to an inaccessible position inside the handle portion.

9. The cleaning appliance of claim 1, wherein the handle portion carries a gripping handle.

10. The cleaning appliance of claim 9, wherein the gripping handle comprises a first gripping area suitable for use when the tubular wand is in the first position and a second gripping area positioned at an angle to the first area and suitable for use when the tubular wand is in the second position.

11. The cleaning appliance of claim 1, wherein, when the tubular wand is in the first position and the handle portion is attached to the main body of the cleaning appliance, the tubular wand extends substantially along the full length of the flexible hose.

12. The cleaning appliance of claim 3, wherein the moveable cap comprises a depending portion on the side thereof facing the tubular wand, the depending portion having a contact surface which, in use, is contacted by the tubular wand when the tubular wand is moved from the first position to the second position.

* * * * *